United States Patent [19]

Foresman

[11] Patent Number: 4,701,145

[45] Date of Patent: Oct. 20, 1987

[54] LIFE-SAVING DEVICE

[76] Inventor: Robert R. Foresman, 26902 Paceo Cardero, San Juan Capistrano, Calif. 92675

[21] Appl. No.: 833,804

[22] Filed: Feb. 28, 1986

[51] Int. Cl.[4] ..... B63C 9/08

[52] U.S. Cl. ..... 441/131

[58] Field of Search ..... 441/80-81, 441/88-89, 106-111, 129-131

[56] References Cited

U.S. PATENT DOCUMENTS

| | | | |
|---|---|---|---|
| 824,664 | 6/1906 | Krieger | 441/123 |
| 988,830 | 4/1911 | Smith | 441/89 |
| 1,237,404 | 8/1917 | Stefanowski | 441/109 |
| 3,074,084 | 1/1963 | Bisch | 441/131 |
| 3,445,868 | 5/1969 | Frieder et al. | 441/81 |

FOREIGN PATENT DOCUMENTS

| | | | |
|---|---|---|---|
| 464325 | 3/1914 | France | 441/88 |
| 2373257 | 8/1978 | France | 441/131 |

*Primary Examiner*—Joseph F. Peters, Jr.
*Assistant Examiner*—Jesûs D. Sotelo
*Attorney, Agent, or Firm*—G. Donald Weber, Jr.

[57] ABSTRACT

A life-saving flotation device which includes an improved life buoy design together with appropriate straps therein and attached thereto, together with suitable hardware comprising hooks and rings for facilitating life-saving operations.

10 Claims, 4 Drawing Figures

LIFE-SAVING DEVICE

BACKGROUND

1. Field of the Invention.

This invention relates to life-saving devices, in general, and to an improved life-saving device, in particular, which includes a unique and improved design of the flotation device together with straps and hardware accessories which enhance the operation thereof. 2. Prior Art.

There are many life-saving devices known in art. The most familiar is, of course, the life-saving ring which is comprised of a suitable flotation material such as wood, Kapok or the like. Typically, these rings or life-preservers are in the form of an annulus which are adapted to be thrown to a person who is in imminent danger in a water environment such as a swimming pools, oceans, rivers, or the like.

One of the difficulties with the conventional ring buoys is that in order to make them readily throwable, they are of relatively small size wherein many individuals cannot physically fit within the confines of the hole in the "doughnut". Consequently, most persons attempt to grasp the life-preserver by slipping an arm therethrough. This is, of course, not very advantageous inasmuch as the life-preserver tends to be displaced and go beneath the surface, causing the person to become concerned to the point of panic.

In a similar fashion, most of the ring buoys which are currently available on the market tend to be relatively rigid or hard. Consequently, there is a significant danger of causing more harm than good by an extremely accurate toss of the buoy which strikes the struggling person and causes them to lose consciousness or be otherwise injured.

In some cases, a line is affixed to the outer circumference of these ring buoys which permits one or more persons to grasp the life buoy in an attempt at a flotation arrangement. This is somewhat better than the situation wherein the line is omitted, especially if the buoy is fabricated of a material which becomes slippery when wet.

Life jackets or life vests are also known in the art. These jackets can be of the inflatable type or those filled with a flotation material such as (old version) Kapok, or the like. These vests usually are adapted to be worn around the torso of a person in need thereof.

Typically, life vests are used in situations wherein the vest can be donned prior to the emergency situation, or at least prior to entering the water.

In the event that the vest must be donned after the person is in the water, the configuration of the vest becomes extremely cumbersome and complex and may cause great consternation to the intended user. Moreover, many life vests include numerous belts and buckles (or inflation devices) which must be operated by the wearer thereof after donning the life vest. Moreover, these belts and buckles may also have to be unfastened prior to putting the vest on.

Moreover, many of the vests include inappropriate distribution of the flotation material so that the wearer of the vest tends to be pitched forward, especially if the person becomes unconscious, whereupon the vest actually creates an unsafe and hazardous condition.

There are also known in the art life saving devices referred to, generally, as slings. These devices are in the nature of an elongated strip or device of a generally flotable material. The sling may comprise one elongated section or number of sections which are joined together in an articulated form. The concept involved with the sling is to place the sling in the water near the person who needs it, who will then slip the sling over his body and under his arms, whereupon the sling is then drawn into the rescue area and the victim is hauled to safety. However, this arrangement frequently is unsuccessful in that the victim may slip through the sling if it is relatively large. Conversely, the victim may be hauled aboard a rescue craft, for example, by means of the sling which tends to cause the victim to be bashed against the side of the vehicle, whereupon other injuries are suffered.

Likewise, the sling tends to place the flotation material under the arms, with little or no flotation material at the back of the victim. However, the closure arrangement at the front of the typical sling does not place sufficient flotation in close proximity to the front of the person. Thus, the victim will tend to be pitched forward, face down, into the water which is an undesirable situation. In any event, the sling is not adequate to maintain the face of the victim out of the water.

The so-called horseshoe-buoy has similar deficiencies. That is, the size and shape of the inner opening space usually will not accomodate the torso of someone other than a small child. Also, the amount of flotation at the back of the bouy, together with the gap in the flotation at the front, tends to pitch the wearer forward, face down in the water.

Reference is herewith made to the co-pending design patent application entitled Life Preserver, bearing Ser. No. 804,090, filed on Dec. 3, 1985 in the name of Robert R. Foresman, the instant inventor.

SUMMARY OF THE INSTANT INVENTION

This invention is directed to a life saving device which comprises a flotation device having a unique design which substantially prevents a wearer thereof from being forced face-down into the water. The device is a body with a generally oval shape with upper and lower surfaces substantially parallel planes and having an aperture therethrough with significant flotation areas at the front and back, with the front flotation area being the larger of the two. The side portions are relatively small areas. The front, back and side portions are defined relative to the aperture. Suitable hardware including straps, buckles, snaps, rings and the like are affixed to or joined in the life ring to form a unitary, composite structure. The hardware, straps and the like are arranged to assist in retaining a wearer within the life saving device.

In an optional arrangement, a man-overboard-pole can be tethered to the life saving device to provide a unique arrangement wherein the life saving operation can be enhanced by permitting a discharge of the life saving equipment to the victim and, as well, marking the location of the victim with a readily visible and easily retrievable apparatus.

DESCRIPTION OF A PREFERRED EMBODIMENT.

Figure 1:
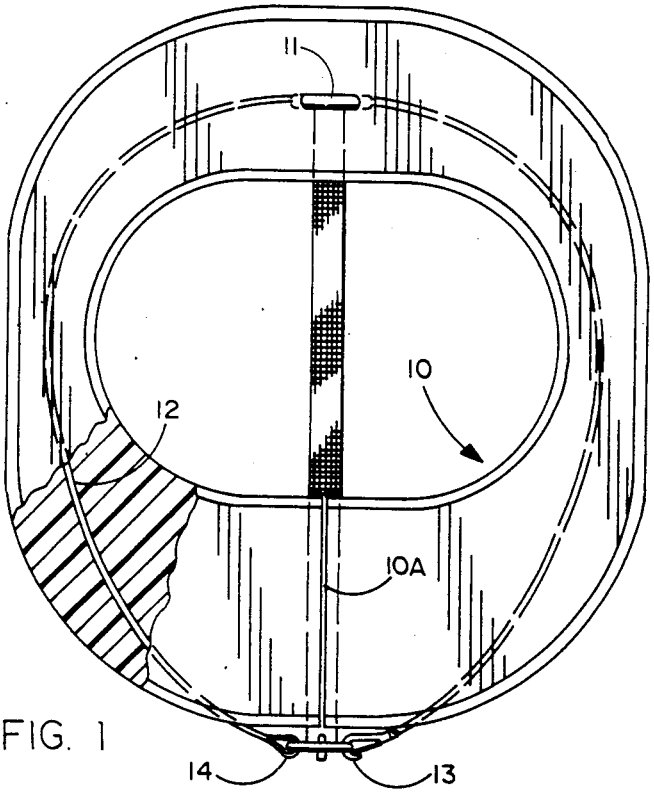
FIG. 1 is a partially broken away plan view of the apparatus of the instant invention.

Referring now to FIG. 1, there is shown a plan view of the apparatus of the instant invention. In particular, FIG. 1 is a plan view of the life saving device, referred to as a C-buoy, which is partially broken away to more readily show the arrangement of the girth strap at 12 therewith. That is, the C-buoy 10 is a substantially oval-shaped device fabricated of a flotation-type material such as closed-cell foam or other similar material. The C-Buoy 10 has a somewhat longer dimension from front to back than from side to side. However, this is not an essential requirement. Moreover, the C-buoy includes a central opening therein which is substantially oval in shape and is disposed slightly closer to the back than to the front. The oval opening is, typically, disposed evenly or centrally on a side-to-side basis. In a preferred embodiment, a slit or cut 10A is provided through the front portion of the C-buoy. The design of the buoy 10, is shown in the co-pending design application referred to above.

With this configuration of the flotation device per se, it is seen that the central opening in the C-buoy is designed to substantially conform to the torso configuration of the person who is intended to wear the device. The opening or slit 10A in the front portion of the device permits ready access to the central opening by displacing the abutting ends of the C-buoy at the front portion of the C-buoy.

It is also noted that the side portions of the C-buoy are relatively narrow so as to fit comfortably under the arms of the user. The back portion of the C-buoy 10 is, as noted, not quite as wide as the front portion of the ring. This has a dual life saving effect. Initially, placing a larger buoyant flotation device at the front portion of the preserver, tends to provide greater buoyancy at the front of the C-buoy. This arrangement has the effect of offsetting the natural forward thrust of the head of a tired or unconscious person in the water. Thus, an unconscious person would tend to be balanced so that his (or her) face is maintained out of the water.

In addition, by having a larger frontal portion, the life preserver operates as a buffer or support in the event that the wearer becomes unconscious and his or her head is tipped forwardly. That is, the large front portion of the ring can act as a ledge or shelf onto which the face of the wearer is caused to rest. This is clearly an advantage over the horseshoe buoy or sling.

Of course, when the preserver is worn with the side portions immediately under the arms, the physiology of the wearer is such that the face will normally be supported a substantial distance above the ring 10, per se.

As noted, the girth strap 12 is embedded in the C-buoy 10. As shown in the broken away portion, the strap is a single piece of a suitable type of heavy-duty strap, such as canvas webbing or any other appropriate material which is, preferrably, Coast Guard approved. In a preferred embodiment, the strap (together with other hardware described hereinafter) is designed to handle a load of approximately 500 pounds with a safety factor of five (5), which permits a load of up to 2500 pounds, o be handled safely.

As shown in FIG. 1, the girth strap is nearly centrally disposed in the body of the C-buoy 10. However, at the front of the C-buoy, the girth strap 12 extends out of the side surface of the C-buoy. One end of the girth strap 12 is connected to a suitable ring 14 while the other end of girth strap 12 is connected to a suitable heavy duty snap hook 13. The snap hook 13 is adapted to engage and hook onto ring 14.

Thus, the wearer first dons the C-buoy 10 and then engages the snap hook 13 with the ring 14 to cause the girth strap to surround the body of the wearer and to form a single closed loop. In addition to having the strap provide a closed loop around the wearer, the secured strap retains the abutting ends of the ring at the slot 10A in close abutment.

Because of the configuration of the C-buoy, the ends of the C-buoy tend to engage one another and to form a substantially uniform ring configuration.

At the rear portion of the apparatus is a large ring 11 which can be, in a preferred embodiment, a D-ring which is joined to the straps in the invention and also partially embedded within the body of C-buoy 10.

Figure 2:
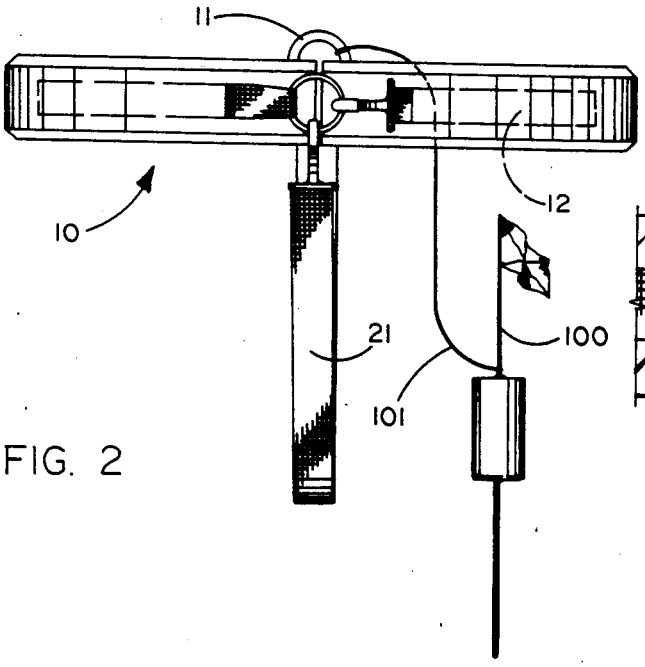
FIG. 2 is an end view of the apparatus of the instant invention with an optional man-overboard-pole connected thereto.

Referring now to FIG. 2, there is shown a front view of the apparatus showing the C-buoy 10 with the girth strap 12 secured therein. Also, the crotch strap 21 is shown depending from the rear portion of C-buoy apparatus and fastened to ring 14 by means of a suitable snap-hook 15 (similar to hook 13). Strap 21 usually fabricated of the same type of material as strap 12.

A man-overboard-pole 100 of conventional design (but not to scale) is shown tethered to the life saving apparatus by a suitable line 101. This line can be tethered to the ring 11 or to another ring mounted in the C-buoy which may be provided if desired or required. The MOP 100 can be deployed with the C-buoy to assist in search and rescue operations.

Figure 3:
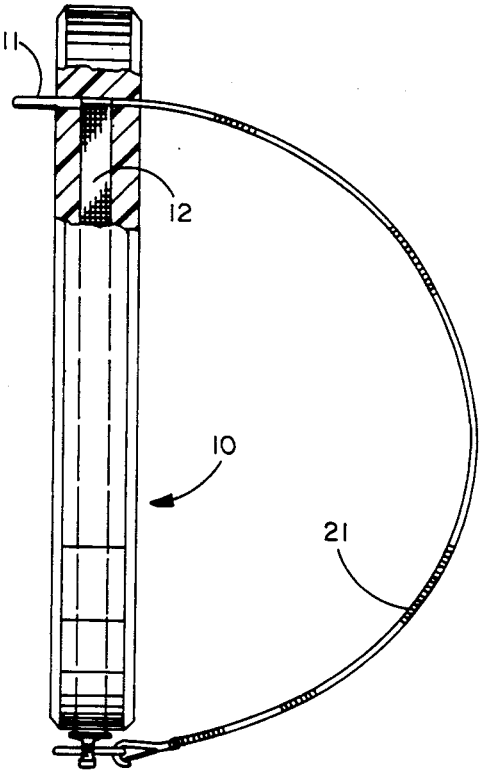
FIG. 3 is a partially broken away side view of the apparatus of the instant invention.

Referring now to FIG. 3, there is shown a side view, partially broken away, of the apparatus of the instant invention. In this showing, the ring 11 is embedded in the body 10. In addition, the ring 11 is connected to a crotch strap 21 which is joined to the girth strap 12 but extends downwardly from the lower surface of C-buoy 10 and includes a snap hook 15 which can be engaged with ring 14 described above.

In this arrangement, the wearer dons the life preserver apparatus, engages hook 13 and ring 14 to provide a secure, substantially unitary life preserver device. The wearer then reaches down and secures the hook 15 of the crotch strap 21 into the ring 14. Thus, the wearer is securely enclosed within the ring device and cannot slip through the ring in the event that the wearer becomes unconscious. In addition, the crotch strap 21 tends to act as a drogue to prevent the C-buoy from moving away from the victim before being put on.

Figure 4:
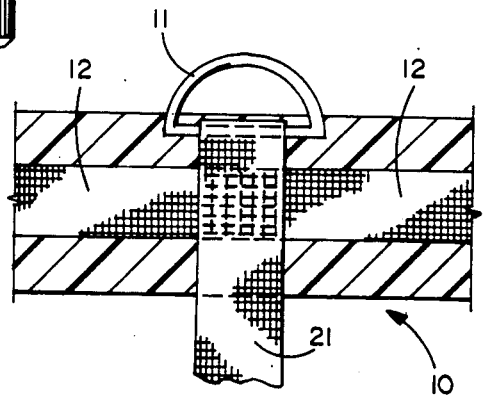
FIG. 4 is a detailed showing of a portion of the apparatus of the instant invention.

Referring now to FIG. 4, there is shown a detailed arrangement of the apparatus of a portion of the instant invention. In this instance, the girth strap 12 is shown disposed in the C-buoy 10. The crotch strap 21 is disposed substantially perpendicular to the girth strap 12.

In the preferred embodiment, a portion of the crotch strap 21 is looped around the D-ring 11 and the overlapped portions are stitched together. In addition, the strap 21 is stitched to the girth strap 12. Thus, the straps 12 and 21 are stitched to each other and the D-ring 11 is stitched into a loop on the strap 21. All of this stitching, together with a portion of strap 21, substantially all of strap 12 and at least a portion of ring 11 are embedded in the C-buoy 10.

By embedding a portion of ring 11 in the body 10, ring 11 tends to remain upright at all times thereby to provide an easy access point for attaching a line or hook to the C-buoy apparatus so that it and the wearer of the life preserver can be retrieved from the water with or without the assistance of the wearer. This permits easy access to an unconscious wearer. Moreover, inasmuch as the ring is located at the rear of the ring apparatus, the back (rather than the front) of the person encounters the side of the vessel, for example, from whence the rescue is made.

Thus, there is shown and described a new and novel life saving apparatus. Specific arrangements are noted. For example, the straps can be formed of canvas webbing or the like. Similarly, the rings, buckles and other hardware can be fabricated of stainless-steel or the like. While the preferred embodiment has been described herein, it is clear that those skilled in the art may conceive modifications thereto. However, any such modifications which fall within the purview of this description are intended to be included therein as well. It is noted that the description is intended to be illustrative only and is not intended to be limitative. Rather, the scope of the invention is limited only by the claims appended hereto.

I claim:

1. A buoyant lifesaving device comprising, a flotation element having a generally oval shape with a front portion, a rear portion, and a pair of side portions joining said front portion and said rear portion so as to define an aperture with a generally oval shape, said flotation element front portion is a relatively larger component than each of said side portions and said rear portion individually, said flotation element including a slit in said front portion which slit communicates with said aperture thereby to produce a pair of closely spaced ends of said front portion in juxtaposition to each other, first strap means imbedded in each of said front, rear and side portions of said flotation element around said aperture, second strap means having one end thereof joined to said first strap and imbedded in said rear portion of said flotation element, and ring means having a portion thereof connected with said second strap means and partially imbedded in said rear portion and a portion thereof extending from said rear portion of said flotation element.

2. The device recited in claim 1 wherein, said rear portion is relatively larger than said side portions.

3. The device recited in claim 1 wherein, the ends of said first strap means extend out of said flotation element at said front part.

4. The device recited in claim 1 wherein, said ring means arranged to protrude from said flotation element substantially perpendicular thereto.

5. The device recited in claim 1 wherein, said flotation element is fabricated of closed cell foam material.

6. The device recited in claim 1 including, indicator means attached to said flotation element to provide for ease in locating said flotation element.

7. The device recited in claim 6 wherein, said indicator means comprises a man-overboard pole which is connected to said flotation element by means of an elongated tether line.

8. A lifesaving device comprising, a flotation element having a generally oval shape, said flotation element having an aperture therethrough, said aperture having a generally oval shape with the long dimension thereof disposed transverse to the long dimension of said flotation element, said flotation element having front portion which is relatively larger than each of the side portions and the rear portion, individually, and wherein said rear portion is relatively larger than each of said side portions, said front portion of said flotation element includes a slit which communicates with said aperture such that the front portion of said flotation element is selectively separable and defines a pair of closely spaced opposed ends, first strap means imbedded in said flotation element around said aperture such that the ends of said first strap means extend out of said flotation element at said front portion on opposite sides of said slit and adjacent to the opposed ends, and second strap means having a portion adjacent to one end thereof joined to said first strap substantially at the midpoint of said first strap and imbedded in the rear portion of said flotation element along with said first strap means.

9. The device recited in claim 8 including, connector means joined to the ends of said first strap means and to a second end of said second strap means for selective connection of said ends of said first strap means and said second end of said second strap means.

10. The device recited in claim 8 including, ring means at least a portion of which is connected to at least one of said first and second strap means and is imbedded in said rear portion of said flotation element.

* * * * *